US006626152B1

(12) United States Patent
Deangelis et al.

(10) Patent No.: US 6,626,152 B1
(45) Date of Patent: Sep. 30, 2003

(54) FUEL RAIL

(75) Inventors: Gary John Deangelis, Spencerport, NY (US); Randal B. White, Palmyra, NY (US)

(73) Assignee: Delphi Technologies, Inc., Troy, MI (US)

( * ) Notice: Subject to any disclaimer, the term of this patent is extended or adjusted under 35 U.S.C. 154(b) by 151 days.

(21) Appl. No.: 09/664,670

(22) Filed: Sep. 19, 2000

(51) Int. Cl.[7] ..... F02M 55/02

(52) U.S. Cl. ..... 123/468; 123/470; 123/456; 428/34.7; 138/137

(58) Field of Search ..... 123/469, 468, 123/470, 456, 467; 138/130, 137; 156/172; 428/34.7, 36.4, 36.91

(56) References Cited

U.S. PATENT DOCUMENTS

| | | | | | |
|---|---|---|---|---|---|
| 3,227,147 | A | * | 1/1966 | Gossiaux | 123/468 |
| 3,866,633 | A | * | 2/1975 | Taylor | 138/130 |
| 4,240,385 | A | * | 12/1980 | Kulke | 123/470 |
| 4,475,516 | A | | 10/1984 | Atkins et al. | 123/470 |
| 4,510,909 | A | | 4/1985 | Elphick et al. | 123/470 |
| 4,539,961 | A | | 9/1985 | Atkins et al. | 123/468 |
| 4,570,600 | A | | 2/1986 | Atkins et al. | 123/468 |
| 4,570,602 | A | | 2/1986 | Atkins et al. | 123/468 |
| 4,586,477 | A | | 5/1986 | Field et al. | 123/468 |
| 4,601,275 | A | | 7/1986 | Weinand | 123/468 |
| 5,003,933 | A | | 4/1991 | Rush, II et al. | |
| 5,163,406 | A | * | 11/1992 | Daly et al. | 123/456 |
| 5,207,848 | A | * | 5/1993 | Mahoney et al. | 156/172 |
| 5,261,375 | A | | 11/1993 | Rush, II et al. | |
| 5,617,827 | A | | 4/1997 | Eshleman et al. | 123/456 |
| 6,062,200 | A | * | 5/2000 | Hofmeister | 123/470 |
| 6,180,197 | B1 | * | 1/2001 | Nie et al. | 428/36.91 |
| 6,257,281 | B1 | * | 7/2001 | Nie et al. | 138/137 |
| 6,294,234 | B1 | * | 9/2001 | Kertesz | 428/34.7 |

* cited by examiner

*Primary Examiner*—Carl S. Miller
(74) *Attorney, Agent, or Firm*—Patrick M. Griffin

(57) ABSTRACT

A composite fuel rail for delivering fuel to the fuel injectors of an internal combustion engine, includes an elongate body having a plurality of axially spaced transversely extending fuel injector sockets. The elongate body also includes an elongate, axially extending fuel passage intersecting the sockets to supply fuel to the sockets. The elongate body has an elongate polymer inner liner made of a chemically inert material that does not degrade substantially when exposed to fuel. The elongate body further includes a fiber reinforced outer shell extending over and covering the inner liner.

10 Claims, 4 Drawing Sheets

FUEL RAIL

TECHNICAL FIELD

The present invention relates to a fuel rail for fuel injected internal combustion engines.

BACKGROUND OF THE INVENTION

Fuel injection systems for internal combustion engines commonly include a plurality of fuel injectors, each of which delivers fuel to an inlet port of the engine combustion chamber. Also, direct injection systems include fuel injectors that injection fuel directly into the combustion chamber of the engine. Such fuel injection systems often include a fuel rail having an elongated fuel passageway that distributes fuel to the fuel injectors through a plurality of fuel injector sockets that connect to the fuel injectors.

One type of fuel injection system includes a fuel pump that supplies pressurized fuel to the fuel rail from the fuel tank, and a fuel pressure regulator maintains the proper pressure within the fuel rail and meters excess fuel that is returned to the fuel tank by a return line. Alternately, returnless fuel systems have been developed that do not require a fuel return.

Existing fuel rails may be made of metal, such as stainless steel, having a relatively high weight, thus adding to the total weight of the vehicle with a resultant reduction in fuel economy. Further, metals have a relatively high thermal conductivity, which tends to cause the fuel to become heated. Finally, metal fuel rails may be relatively expensive to produce.

SUMMARY OF THE INVENTION

One aspect of the present invention is a composite fuel rail for delivering fuel to the fuel injectors of an internal combustion engine. The fuel rail includes an elongate body having a plurality of axially spaced transversely extending fuel injector sockets. The elongate body also includes an elongate, axially extending fuel passage intersecting the sockets to supply fuel to the sockets. The elongate body has an elongate polymer inner liner made of a chemically inert material that does not degrade substantially when exposed to fuel. The elongate body further includes a fiber reinforced outer shell extending over and covering the inner liner.

Another aspect of the present invention is a fuel rail for delivering fuel to the fuel injectors of an internal combustion engine. The fuel rail includes an elongate body having a plurality of axially spaced fuel injector sockets and an axially extending fuel passage intersecting the sockets to supply fuel to the sockets. The elongate body has an inner sleeve of liner made of a first fiber reinforced material. The elongate body also has an outer shell made of a second fiber reinforced material enveloping the inner liner.

Yet another aspect of the present invention is a method of fabricating a composite fuel rail, including providing a first mold cavity having a shape capable of producing an inner liner of a fuel rail. A second mold cavity is provided, the second mold cavity having a shape capable of producing an outer shell over an inner liner produced by the first mold cavity. A first polymer material is injected into the first mold cavity to form an inner liner having an elongate fuel passageway and a plurality of axially spaced fuel injector ports adapted to provide fuel to fuel injectors. The inner liner is positioned in the second mold cavity, and a second polymer material is injected into the second mold cavity to form an outer shell over the inner liner.

These and other features, advantages and objects of the present invention will be further understood and appreciated by those skilled in the art by reference to the following specification, claims and appended drawings.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
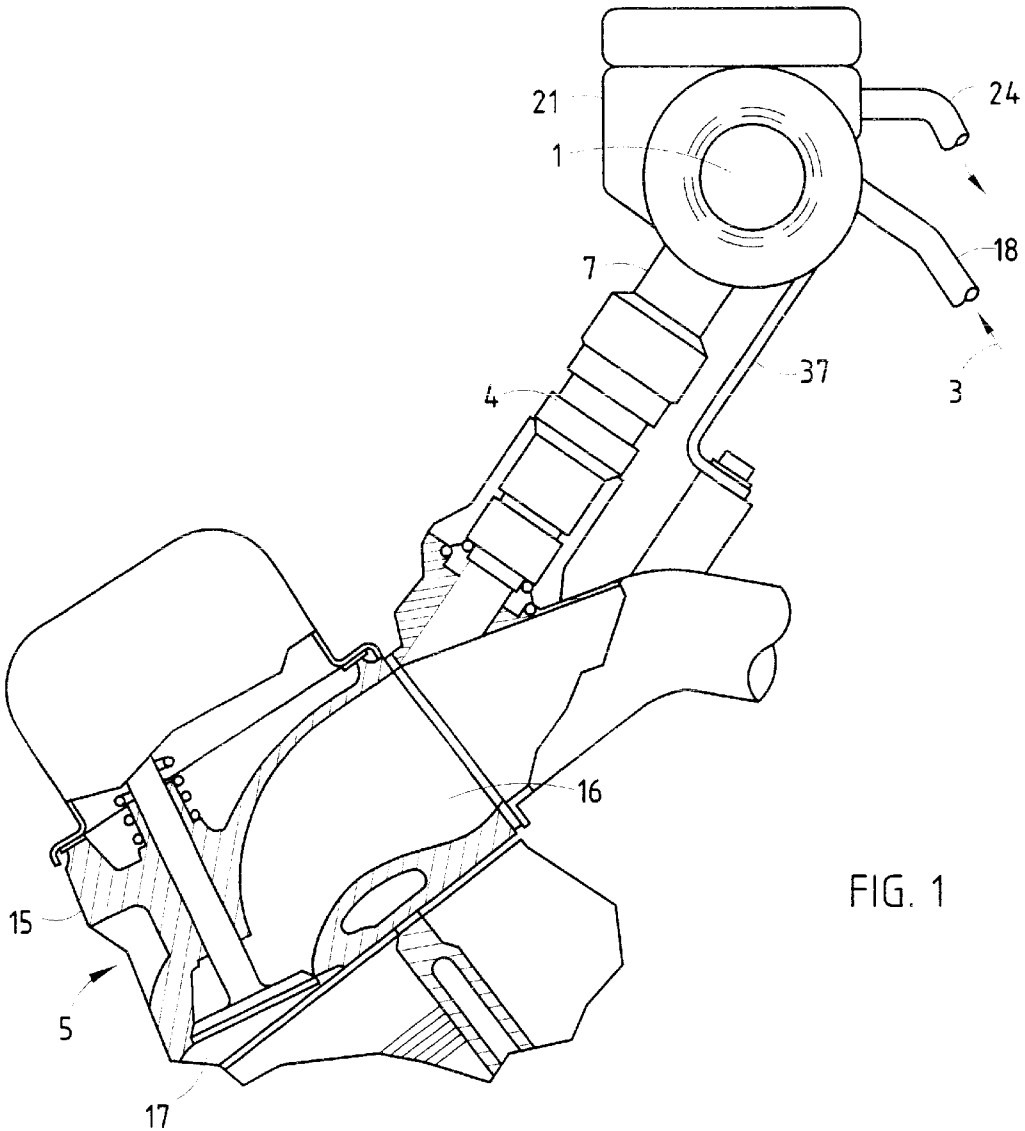
FIG. 1 is fragmentary, partial cross-sectional view of a portion of an internal combustion engine including a composite fuel rail of the present invention.

For purposes of description herein, the terms "upper," lower, "right," left, "rear," front, "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
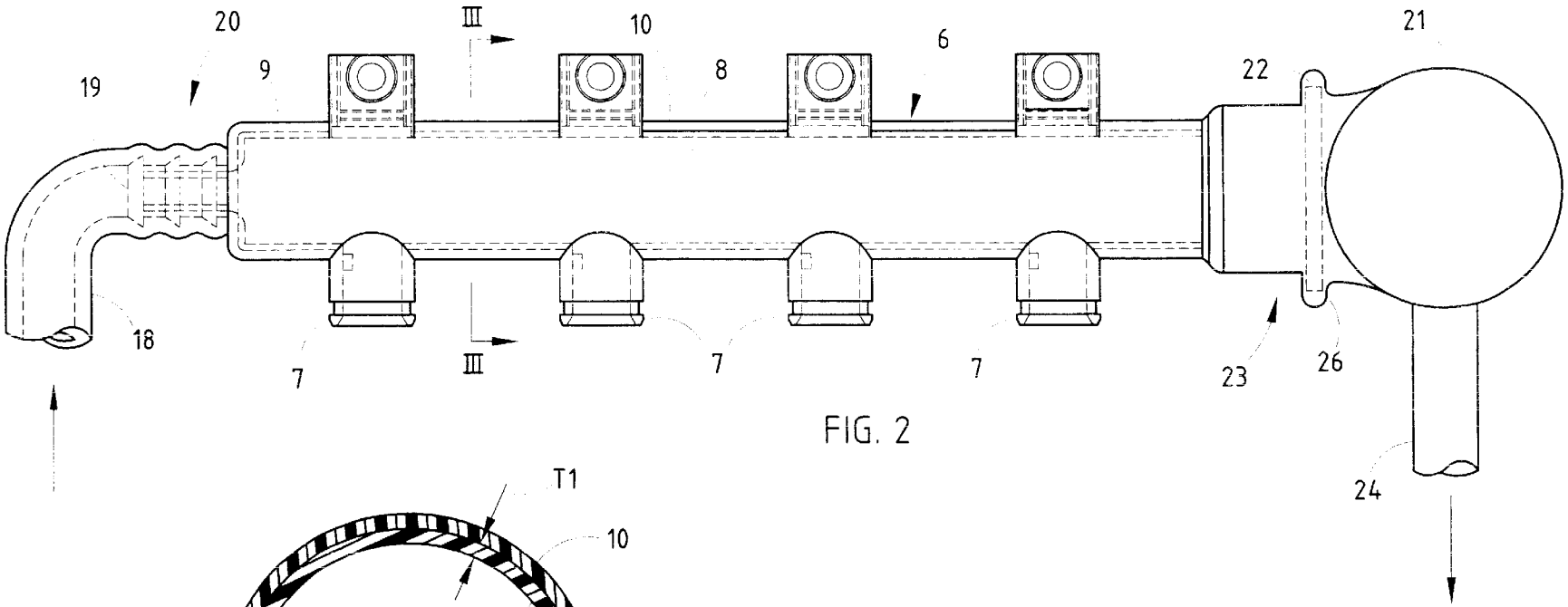
FIG. 2 is a partially fragmentary front elevational view of the composite fuel rail of the present invention.
Figure 3:
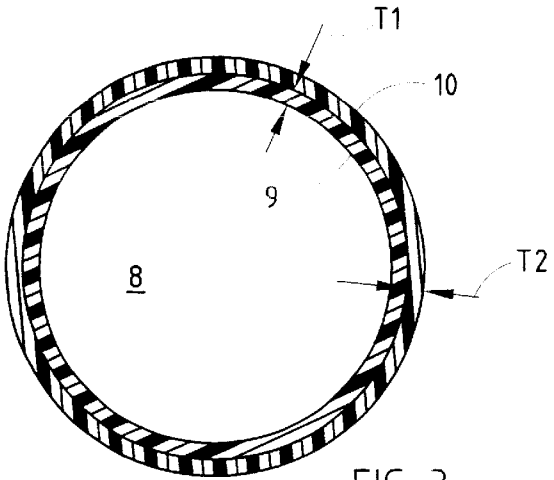
FIG. 3 is a cross-sectional view of the composite fuel rail of FIG. 2 taken along the line III—III.

The reference numeral 1 (FIG. 1) generally designates a composite fuel rail embodying the present invention. In the illustrated example, composite fuel rail 1 is designed for delivering fuel 3 to the fuel injectors 4 of an internal combustion engine 5. With further reference to FIG. 2, composite fuel rail 1 includes an elongate body 6 having a plurality of axially spaced transversely extending fuel injector sockets 7 and an elongate axially extending fuel passage 8 intersecting the sockets 7 to supply fuel to the sockets 7. The elongate body 6 has an elongate polymer inner liner 9 (see also FIG. 3) made of a chemically inert material that does not degrade substantially when exposed to fuel. The elongate body 6 further includes a fiber reinforced outer shell 10 extending over and covering the inner liner 9.

With reference to FIG. 1, a cylinder head 15 of internal combustion engine 5 includes an intake port 16 that supplies an air/fuel mixture to the combustion chamber 17. A conventional fuel injector 4 supplies fuel to each of the intake ports 16. A fuel line 18 is connected to a fitting 19 (FIG. 2) of fuel rail 1, and supplies pressurized fuel 3 from a fuel tank (also not shown) via a fuel pump (not shown). In the illustrated example, a conventional fuel pressure regulator 21 is secured to a flange or fitting 22 at a second end 23 of fuel rail 1 via a crimped metal plug member 26. Fuel pressure regulator 21 meters fuel flow to return line 24 and maintains a desired fuel pressure within the fuel rail 1. Fuel rail 1 of the present invention could also be used with returnless fuel injection systems wherein a fuel pressure regulator 21 and return line 24 are not utilized. In a returnless system, second end 23 of elongate body 6 would be closed off to prevent exit of fuel.

Figure 4:
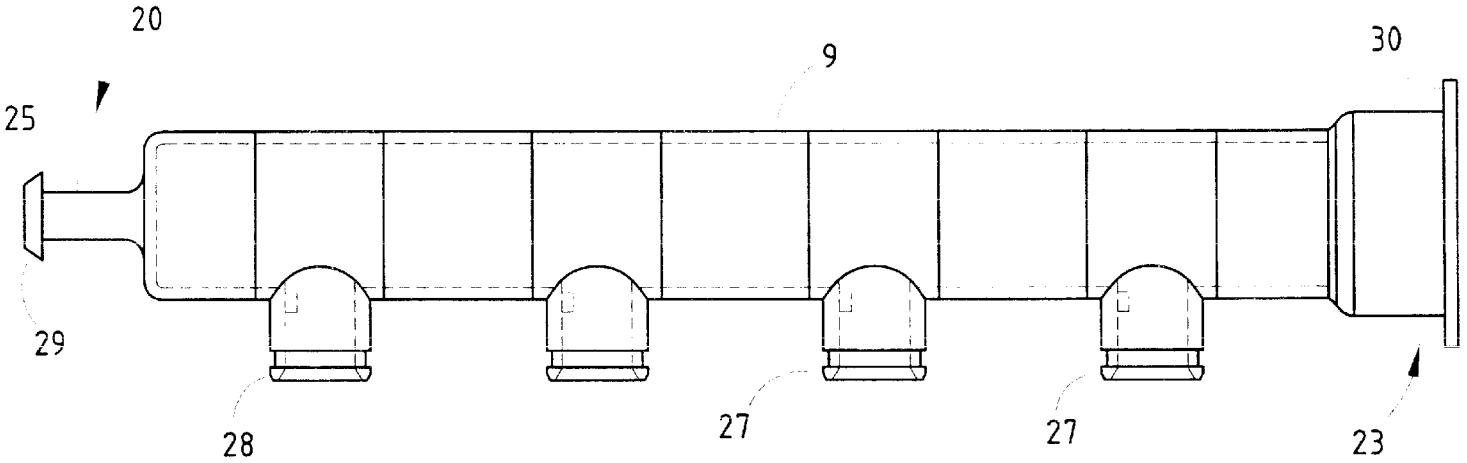
FIG. 4 is a front elevational view of the inner liner of the composite fuel rail of FIG. 2.

With further reference to FIG. 4, inner liner 9 includes a plurality of transverse tubular portions 27 forming the inner sidewall surface of fuel injector sockets 7. In the illustrated example, each tubular section 27 includes an annular lip or flange 28 at the end thereof, forming a standard connector for connection to the fuel injectors. A tubular inner portion 25 at first end 20 of inner liner 9 provides the inner sidewall for fitting 19, and includes a tapered annular flange 29 forming the end of a standard fitting for connecting fuel line 18. Second end 23 of inner liner 9 includes an annular flange 30 forming the inner portion of flange 22 (FIG. 2). Flange 22 forms a standard fitting for mounting of a standard fuel pressure regulator 21 via crimped plug 26. The fuel fittings and fuel injector sockets of fuel rail 1 may be configured to provide various standard connections to existing fuel lines and fuel injectors 4. Inner liner 9 is formed over a mold core (not shown), and preferably has a wall thickness T1 (FIG. 3) that is selected to provide sufficient sealing and structural strength for a particular application. T1 is generally in the range of about 0.040–0.070 inches. Thickness T1 will also depend upon the type of material inner liner 9 is made of, as well as the material, thickness, and related properties of the outer shell 10.

Figure 5:
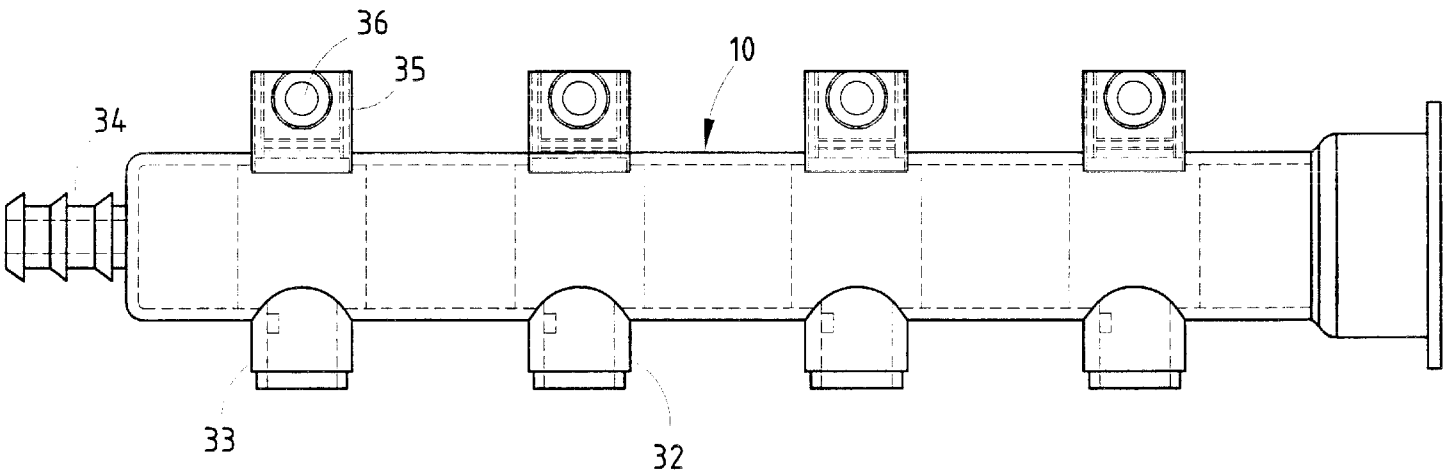
FIG. 5 is a front elevational view of the outer shell of the composite fuel rail of FIG. 2.

With further reference to FIG. 5, outer shell 10 includes a plurality of tubular portions 33 providing an outer covering for fuel injector sockets 7. A barbed portion 34 extends over the inner portion 25 of inner liner 9 and forms fitting 19 to retain fuel line 18. A plurality of tabs or brackets 35 are positioned along the outer shell 10, and include openings 36 that receive a standard threaded fastener (not shown) to secure the fuel rail 1 to a bracket 37 (FIG. 1). In order to simplify construction and provide optimum strength, the connector tab or brackets 35 are formed entirely of the material of outer shell 10, without any material from inner liner 9. Outer shell 10 has a sidewall thickness T2 (FIG. 3) that is selected to provide sufficient mechanical, thermal, and sealing requirements for a particular application. The properties of the chosen material will influence the required thickness T2. T2 is generally in the range of about 0.040–0.070 inches thick. T1 and T2 will generally be selected at opposite ends of this range. For example, T1 may be 0.040 inches, and T2 would then be 0.070 inches. Alternately, T1 could be 0.070 inches, and T2 would then be 0.040 inches. The thicknesses of T1 and T2 are chosen based upon the mechanical and sealing properties required, as well as the materials chosen for inner liner 9 and outer shell 10.

The inner liner 9 is made of a chemically inert, fuel resistant material capable of withstanding the fuel temperature and pressure of the system. Outer shell 10 is made of an impact resistant, temperature resistant material, and provides an overall crash barrier to the inner liner 9. Either material can be used for permeation resistance, depending upon the fuel utilized in a particular application. Material combinations can be chosen that resist both hydrocarbon and alcohol fuels simultaneously without unduly limiting physical or mechanical properties. Although many combinations of materials are possible, the following combinations of materials for the inner and outer shells may be utilized:

| Inner liner | Outer shell |
|---|---|
| Polyamide 6/6 w/glass reinforcement | Polyphthalamide (PPA) w/glass reinforcement |
| Polyamide 6/6 w/glass reinforcement | Polybutylene terephthalate (PBT) w/glass reinforcement |
| Polyphenylene Sulfide (PPS) w/glass reinforcement | Polyamide 6/6 w/glass reinforcement |
| Polyphenylene Sulfide (PPS) w/glass reinforcement | Polyphthalamide w/glass reinforcement |
| Polyphenylene Sulfide (PPS) w/glass reinforcement | Polybutylene terephthalate (PBT) w/glass reinforcement |
| Polyoxymethylene (POM) w/glass reinforcement | Polyamide 6/6 w/glass reinforcement |
| Polyoxymethylene (POM) w/glass reinforcement | Polyphthalamide (PPA) w/glass reinforcement |
| Polyethylene tetrafluoroethylene (ETFE) copolymer w/glass reinforcement | Polyamide 6/6 w/glass reinforcement |
| Polyethylene tetrafluoroethylene (ETFE) copolymer w/glass reinforcement | Polyphthalamide (PPA) w/glass reinforcement |
| Liquid Crystal Polymer (LCP) w/glass reinforcement | Polybutylene terephthalate (PBT) w/glass reinforcement |

The particular material combination will depend upon the fuel used as well as the impact resistance, thermal resistance and insulating properties required for a particular application. The wall thicknesses of the inner liner 9 and outer shell 10, as well as the material properties, can be chosen to provide a fuel rail that is substantially lighter than traditional metal fuel rails, provides thermal insulation for the fuel, while also reducing the cost of the fuel rail. Further, the fuel line fittings and fuel sockets may be integrally molded with the fuel rail 1, thus reducing the number of parts and related assembly steps required during fabrication.

Figure 6:
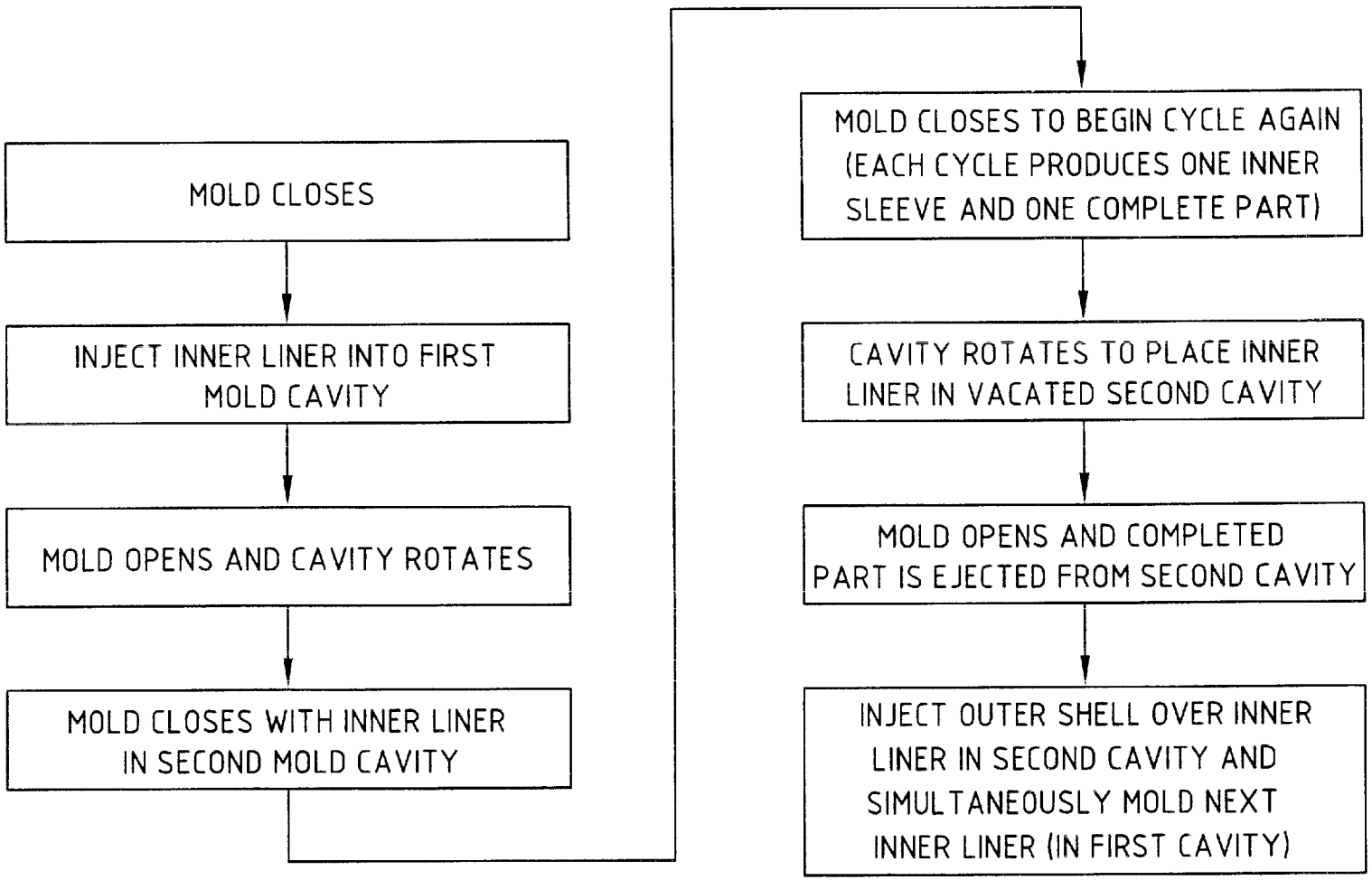
FIG. 6 is a flow chart illustrating the fabrication method utilized to produce the fuel rail of the present invention.

With further reference to FIG. 6, the composite fuel rail 1 is fabricated by a "two shot" injection molding process, wherein the first material of the inner liner 9 is injected into a first mold cavity. An elongated mold core extends into the first mold cavity to form the fuel passageway 8 extending through the elongate body 6. After the first material solidifies to form the inner liner 9, the mold opens, and the cavity rotates or shuttles to a second position. The mold includes a second mold cavity that is then closed around the inner liner and mold core. The inner liner 9 remains positioned on the mold core when positioned in the second mold cavity. The second material is then injected into the second mold cavity, forming the outer shell 10. A first polymer material is simultaneously injected into the first mold cavity to form the next inner liner 9. The mold then opens, and the completed part is ejected from the second cavity. The second cavity is then rotated or shuttled to place the next inner liner in the vacated second cavity, and the mold closes to begin the next cycle. Rotary mold equipment is commercially available from suppliers such as Husky Molding Systems of Bolten, Ontario, Canada. Although "two shot" molding is know for smaller parts, such as toothbrush handles or the like having softer and harder portions, the present process of fabricating a composite fuel rail is believed to be unique. Further, leaving the inner liner 9 on the mold core during transport to the second mold cavity, and during injection of the second material into the second mold cavity is also believed to be unique.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

What is claimed is:

1. A composite fuel rail for delivering fuel to the fuel injectors of an internal combustion engine, comprising:

an elongate body having a plurality of axially spaced fuel injector sockets extending transversely from said elongate body, said fuel injector sockets formed integrally with said elongate body, each socket defining a fuel passageway, said elongate body and sockets having an elongate polymer inner liner made of a chemically inert material that does not degrade substantially when exposed to fuel, said elongate body and sockets further including a fiber reinforced outer shell extending over and covering said inner liner.

2. The composite fuel rail set forth in claim 1, wherein:

said inner liner is made of a fiber reinforced material.

3. The composite fuel rail set forth in claim 1, wherein:

said inner liner is molded of a thermoplastic material.

4. The composite fuel rail set forth in claim 1, wherein:

said inner liner is generally tubular.

5. The composite fuel rail set forth in claim 1, wherein:

said inner liner includes an annular flange extending around each fuel injector socket for connection of a fuel injector.

6. A fuel rail for delivering fuel to the fuel injectors of an internal combustion engine, comprising:

an elongate body having a plurality of axially spaced fuel injector sockets and an elongate axially extending fuel passage intersecting said sockets to supply fuel to said sockets; said elongate body and said sockets having an inner liner made of a first fiber reinforced material, and an outer shell made of a second fiber reinforced material enveloping said inner liner.

7. The fuel rail set forth in claim 6, wherein:

said inner liner is made of a material that is resistant to degradation when exposed to fuel.

8. The composite fuel rail set forth in claim 6, wherein:

said inner liner is molded of a thermoplastic material.

9. The composite fuel rail set forth in claim 6, wherein:

said inner liner is generally tubular.

10. The composite fuel rail set forth in claim 6, wherein:

said inner liner includes an annular flange extending around each fuel injector socket for connection of a fuel injector.

* * * * *